US006673231B2

(12) United States Patent
Kim et al.

(10) Patent No.: US 6,673,231 B2
(45) Date of Patent: Jan. 6, 2004

(54) METHOD FOR REMOVING SLUDGE IN CRUDE OIL TANK AND RECOVERING OIL THEREFROM

(75) Inventors: Myung-Jun Kim, Taejon (KR); Dae-Seog Yoon, Ulsan (KR); Chang-Hyo Choi, Ulsan (KR); June-Tae Choi, Taejon (KR); Jong-Won Kwak, Ulsan (KR); Sung-Kil Park, Ulsan (KR)

(73) Assignee: SK Corporation, Seoul (KR)

( * ) Notice: Subject to any disclaimer, the term of this patent is extended or adjusted under 35 U.S.C. 154(b) by 50 days.

(21) Appl. No.: 09/962,359

(22) Filed: Sep. 24, 2001

(65) Prior Publication Data

US 2002/0153279 A1 Oct. 24, 2002

(30) Foreign Application Priority Data

Feb. 20, 2001 (KR) ..... 2001-8398

(51) Int. Cl.[7] ..... C10G 17/00

(52) U.S. Cl. ..... 208/13; 134/40; 134/5; 134/22.19; 137/15.04

(58) Field of Search ..... 208/13; 134/40, 134/5, 22.19; 137/15.04

(56) References Cited

U.S. PATENT DOCUMENTS 2,066,166 A * 12/1936 Strezynski et al. ..... 208/13
5,580,391 A * 12/1996 Franco et al. ..... 134/5

FOREIGN PATENT DOCUMENTS

DE 4224953 C1 * 12/1993 ..... C02F/11/00
FR WO 9932238 A1 * 7/1999 ..... B08B/9/093
WO WO 99/00544 * 1/1999 ..... D06M/16/00

* cited by examiner

*Primary Examiner*—Walter D. Griffin
*Assistant Examiner*—James Arnold, Jr.
(74) *Attorney, Agent, or Firm*—Abelman, Frayne & Schwab

(57) ABSTRACT

Disclosed is a method for removing sludge in a crude oil storage tank by use of thermal oil discharged from a distillation tower of an oil refinery, such as atmospheric residue, vacuum residue, or vacuum gas oil, and recovering oil having various applications by separating inorganics therefrom. The method is advantageous in terms of minimizing air pollution because of utilizing a closed system, drastically reduced washing time of crude oil storage tank, and continuous removal of the sludge. Additionally, the recovered oil can be provided as fuel oil, marine oil or a feed for secondary treatment processes, such as up-grading processes of heavy oil.

10 Claims, 6 Drawing Sheets

METHOD FOR REMOVING SLUDGE IN CRUDE OIL TANK AND RECOVERING OIL THEREFROM

BACKGROUND OF THE INVENTION

1. Field of the Invention

The present invention pertains, in general, to a method for removing sludge accumulated in a crude oil tank on storage of crude oil in an oil refinery, and recovering oil therefrom. More specifically, the present invention pertains to a method for removing sludge in a crude oil storage tank by use of thermal oil, such as atmospheric residue, vacuum residue and vacuum gas oil yielded from an oil refinery, and recovering oil having various applications by separating inorganics from the removed sludge.

2. Description of the Prior Art

Generally, the term "crude oil" refers to oil recovered from below the earth's surface which remains untreated or unrefined. The problem begins when contaminants settle down on the bottom of oil storage tanks. Contaminants come from various sources and some of the contaminants are indigenous to the crude oil itself. Sludge is formed when naturally occurring solids as well as rust from piping and tank walls, and higher molecular weight hydrocarbons are separated from lighter hydrocarbons, and sink to storage tank bottoms. Such sludge is present in the form of stable emulsions consisting of long-chain paraffin, asphaltenes, inorganics and water.

In many countries, a crude oil storage tank of an oil refinery must be regularly examined every 8–10 years because of danger of oil spills by leaks of the tank. As such, the sludge accumulated in the crude oil storage tank is cleaned by several methods. However, when oil spill accidents occur despite such prior examination, the sludge should be cleaned prior to repairing the crude oil storage tank. Also, the accumulated sludge reduces the storage capacity. In addition, when the sludge is not removed for long periods of time and accumulated to the height of the crude oil-outlet, it overflows the tank and thus flows into the next process, thereby negatively affecting the total processes. In particular, if the level of the sludge is higher than that of the crude oil outlet, large quantities of the sludge flow into the process, thus charge pump trip of the crude oil occurring. Inflow of the sludge results in shortening cleaning cycle period of a heat exchanger and deactivation of a catalyst, and reducing of throughput attributed to frequent filtering operation in catalyst process. Therefore, every oil refinery invests much time and money for treatment of the sludge, but there is no other method except that the sludge-accumulated tank is opened, and then the sludge is removed. Hence, tank desludging processes (TDSP) have been under vigorous study.

Said sludge treatment techniques are classified into removal and discharge of the sludge from the tank; and separation and recovery of oil from discharged sludge. The discharge technique is exemplified by manners of introducing humans or bulldozer into the tank (SuperMacs), melting the sludge by installation of a heating tube or use of steam, and milling and discharging the sludge by ejecting the stream of crude oil under high pressure using a nozzle mounted on the tank.

SuperMacs technique mainly used in Korea, as stated above, discharges the sludge by ventilating harmful hydrocarbon gas filled in the tank after the tank is opened, and operating a vacuum pump-mounted bulldozer in the tank by an operator. The discharged sludge is melted by the steam, and then centrifuged to remove rust dregs and mud, thus recovered oil being back introduced into another tank. However, at that time, vicious cycles, in which the recovered oil becomes solidified over again and thus sludge is formed, are repeated. Furthermore, since said procedure is carried out in an opened system, environmental problems such as air pollution occur, and cleaning time (80–100 tons of sludge/day) is so long that it is undesirable in the applicatory aspect.

In the case of Statia Terminals (Oil & Gas Journal, Feb. 20, 1995) in Canada, the sludge is melted using a gas heater by installing a heating tube to the tank, but installation of the gas heater in the crude oil-storage area is complicated and dangerous, so the gas heater is difficult to apply to an oil refinery.

A method for crushing and discharging the sludge through ejection of a crude oil stream under high pressure using a nozzle has been used in Japan and Western countries. In Japan, a manner for crushing the sludge by ejecting the oil under high pressure through tens of ejection nozzles mounted on the tank roof, so called crude oil washing, has been employed. In Western countries, a manner for crushing the sludge by mounting a high pressure pump of large positive displacement and a nozzle to the manhole of the tank has been widely used.

In this regard, U.S. Pat. No. 5,078,799 discloses that crude oil is taken from an upward region of the tank, pumped upwardly to a suction pump-pressure pump unit located, for example, on top of a floating roof of the tank, the pressurized crude oil taken from the top portion of the tank being reintroduced through a preferably rotating liquefaction lance to a region in the vicinity of the sedimented sludge. In the above process, the pressure is converted into hydrodynamic energy. Preferably, a plurality of such lances are used, arranged with respect to each other to form eddies or vorteces, to establish flow patterns within the tank, thereby liquefying the sludge and rendering it into pumpable fluid condition for removal from the tank. Further, U.S. Pat. Nos. 4,945,933, 5,019,016 and 5,460,331 disclose an apparatus for dispersing sludge contained in a crude oil storage tank by use of a crude oil circulator, capable of forming jet flow by a plural number of rotatable nozzles positioned within the tank. However, said patents have the disadvantages that introduction of the sludge-dispersed crude oil causes fouling during distillation process and negatively affects other processes, and long periods of time are required to install the nozzle and the pump, and also the installation thereof is complicated.

When the discharged sludge is wasted, it is classified as malignant waste so that treatment cost becomes high, thus the sludge should be preferentially treated. Hence, a method for recovering the oil from the sludge is very important. Techniques for separating and recovering oil from the discharged sludge include a mechanical separation method using a centrifuge as disclosed in U.S. Pat. No. 4,990,237 and a thermal separation method as well as a solvent extraction or a sonic separation method.

Further, U.S. Pat. No. 5,085,710 refers to a process for separating and removing the hydrocarbon, water and solid components of sludge deposited in an oil storage tank which comprises: introducing a sufficient amount of a nonionic surfactant in an aqueous solution to form a layer of the solution above the sludge layer, said nonionic surfactant comprising $C_{8-12}$ alkylphenol-ethylene oxide adduct, said nonionic surfactant being present in a quantity sufficient to separate hydrocarbon components from the sludge without forming an emulsion; adding a diluent, immiscible with the aqueous layer, for extracting the hydrocarbons; and separately draining the diluent layer and aqueous layer from the tank. But, said patent suffers from the disadvantage of using unfavorable chemicals in terms of the protection of the environment.

Also, U.S. Pat. No. 6,069,002 discloses a method for using a biological system to recover a hydrocarbon volume and minimize waste from a sludge oil in an oil storage tank, which includes the steps of: introducing a treatment solution comprising a volume of water, nitrogen source, phosphates, and microorganisms into the storage tank to break down the sludge oil into, in part, the hydrocarbon volume; heating the treatment solution; vigorously mixing and agitating the contents of the storage tank including the sludge; breaking down the sludge with the microorganisms; and removing the hydrocarbon volume from the storage tank as a useable and processable hydrocarbon fluid.

In addition to said techniques, various methods for the sludge removal and its treatment have been presented but are disadvantageous in terms of removal efficiency, washing time and economic efficiency. Accordingly, studies on related techniques have been carried out.

SUMMARY OF THE INVENTION

Leading to the present invention, the intensive and thorough research for using atmospheric residue, vacuum residue and vacuum gas oil, yielded from a distillation tower of an oil refinery, as thermal oil, and utilizing the heat contained in said oils, carried out by the present inventors aiming to avoid the problems encountered in the prior arts, resulted in the finding that sludge in a crude oil storage tank is melted and then discharged within short periods of time using said thermal oil, which is then left to stand in said crude oil storage tank or an additional separation tank, inorganics settled from said sludge being removed to a level of tens of ppm, therefore oil recovery being 95% or higher, thereby using said recovered oil as marine fuel or a feed for up-grading processes in an oil refinery.

Therefore, it is an object of the present invention to provide a method for removing sludge and recovering oil therefrom, capable of minimizing air pollution by removing the sludge from the crude oil tank under a closed system.

It is another object of the present invention to provide a method for removing sludge and recovering oil therefrom, this operation capable of being easily performed with minimal initial investment cost, drastically reducing washing time of a crude oil storage tank and continuously removing the sludge.

It is a further object of the present invention to provide a method for removing sludge and recovering oil therefrom, in which thermal oil of high temperature yielded from a crude oil-distillation process is used to remove the sludge, thus increasing economic efficiency of the process.

It is still another object of the present invention to provide a method for providing recovered oil as marine oil or feed for secondary treatment processes such as up-grading processes of heavy oil.

In accordance with an embodiment of the present invention, there is provided a method for removing sludge and recovering oil therefrom, comprising (a) introducing thermal oil yielded from an oil refining process, to sludge accumulated in a crude oil storage tank, at a volume ratio of 3:1 to 20:1, said thermal oil being selected from the group consisting of atmospheric residue, vacuum residue and vacuum gas oil; (b) melting the sludge until a mixture of said thermal oil and the sludge has a homogeneous temperature distribution with or without stirring said introduced thermal oil and sludge; (c) settling inorganics by allowing the mixture of said thermal oil and sludge to stand in said storage tank or an additional separation tank connected to said storage tank; and (d) recovering oil from the mixture of said thermal oil and sludge.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
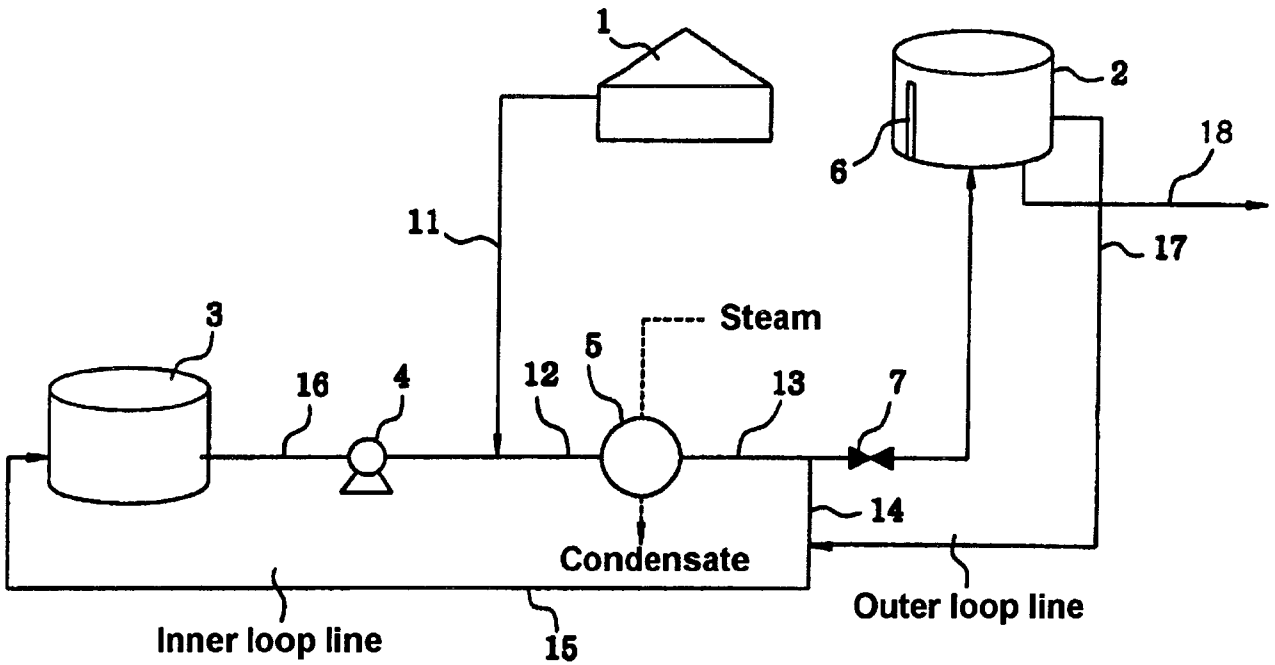
FIG. 1 is a schematic view showing an embodiment of a process for removing sludge and recovering oil according to the present invention.

In the present invention, it is preferred that thermal oil used to remove sludge has a high boiling point and high flash point, and low vapor pressure in terms of safe handling and environmental protection. Furthermore, a relatively small amount of paraffin is preferably contained in the thermal oil. Examples of such thermal oil include atmospheric residue, vacuum residue, vacuum gas oil, and the general properties thereof are given in the following table 1.

TABLE 1

| Properties | Atmospheric Residue | Vacuum Residue | Vacuum Gas Oil |
|---|---|---|---|
| Boiling point (° C.) | 260–550 | 270–580 | 250–270 |
| Specific gravity | 0.90–0.99 | 0.98–0.99 | 0.9–0.95 |

From the table 1, the thermal oil useful in the present invention is about 250–580° C. in boiling point and approximately 0.90–1.0 in specific gravity.

In particular, the atmospheric residue is preferably used as the thermal oil, because oil constituting 85–97% of sludge contains more paraffin than the atmospheric residue and, when the oil mixed with slightly lighter components or atmospheric residue is recovered, it may be used as fuel oil, marine oil or a feed for up-grading processes. The atmospheric residue having high boiling point is favorable in terms of safety and pollution reduction, and has similar advantages to the recovered oil. The atmospheric residue constituting 30–40% of crude oil may be sufficiently provided, and the storage temperature thereof is about 80–130° C. according to use, so that, when it is directly used as a heat source, the sludge removal process can be carried out with no additional equipment required for heating, thereby generating economic benefit.

LCO (light cycle oil), kerosene, and LGO (light gas oil) may be used as the thermal oil for sludge removal, but the value of the above oil is higher than that of the recovered oil, thus causing economic loss.

Meanwhile, for optimal sludge removal and oil recovery process, the sludge analysis and the determination of various process parameters should be performed.

Sludge Sample Analysis and Operating Conditions of Sludge Removal Process

For obtaining optimal operation procedure, analyses of components and properties of the sludge accumulated in a crude oil storage tank should be done first, because the amount of recoverable oil and kinds of inorganics can be found from such sludge analysis. As such, water content of the sludge, ignition loss and the content of inorganics are determined.

The properties of the sludge accumulated in the crude oil storage tank depend on handling of crude oil, cleaning cycle and the like. Water is contained at the amount of 5–28 wt %, and the contents of asphaltenes and inorganics are 2–38 wt %, in the case of pure sludge. In particular, the main inorganic component is iron (Fe), and the corrosion degree of the tank is proportional to the accumulation period of time of the sludge in the tank. From the results of such sludge analysis, the amounts of necessary thermal oil and the inorganics to be treated may be deduced.

To find the operating conditions for the sludge removal process, the melting point and heat of fusion of the sludge, the amount of oil in the sludge, and viscosity and pour point of the recovered oil are analyzed. In addition, it is required to determine the effects of crude oil remaining in the sludge on the vapor pressure under the operating condition for safety.

The analyzed distillation data and viscosity of the atmospheric residue and the sludge are shown in the Tables 2 and 3, below. The used thermal oil is atmospheric residue with high sulfur content in crude oil, and the sludge is a common one accumulated in crude oil storage tanks.

TABLE 2

DISTILLATION DATA OF ATMOSPHERIC RESIDUE

| Vol % | Temp. (° C.) |
|---|---|
| IBP | 208 |
| 5 | 302 |
| 10 | 343 |
| 20 | 399 |
| 30 | 435 |
| 40 | 466 |
| 50 | 500 |
| 57 | 522 |

Specific gravity: 0.9526
Viscosity: 24 cP at 50° C.

TABLE 3

DISTILLATION DATA OF SLUDGE

| Vol % | Temp. (° C.) |
|---|---|
| IBP | 245 |
| 5 | 314 |
| 10 | 344 |
| 20 | 356 |
| 30 | 357 |
| 40 | 362 |
| 50 | 365 |
| 60 | 371 |
| 70 | 386 |
| 80 | 498 |
| 87 | 565 |

Specific gravity: 0.9972
American Petroleum Institute Degree: 10.4

In the sludge removal process of the present invention, the volume ratio of thermal oil/sludge is adjusted to about 3–20, depending on the property of the sludge to be treated or the thermal oil to be used. For example, when the data in the above tables 2 and 3 are considered, the volume ratio of atmospheric residue/sludge is preferably about 8.

Conventionally, the crude oil storage tank has been regarded as an off-site in the oil refining process. On the other hand, the present invention is considering the above crude oil storage tank as an on-site in the oil refining process as well as providing an effective removing method of the sludge accumulated therein. In addition, the thermal oil with high temperature discharged as a bottom fraction from the distillation tower in oil refining processes can be used to removed the sludge, and the retention heat thereof can be utilized, thereby economic benefit may be obtained. In particular, the sludge removal process in accordance with the present invention may be operated in a closed system, thus preventing environmental problems, such as air pollution, by organics.

As described above, the sludge removal process is carried out after the operation conditions are determined according to the sludge analysis and main parameters of processes.

The thermal oil yielded from a distillation step in an oil refinery is preheated to 50–130° C., operation temperature, and then introduced into the sludge-accumulated crude oil storage tank. Generally, the temperature of the thermal oil discharged from the distillation tower is 80–130° C. and, in this case, the preheating step is not needed. The amount of thermal oil to be introduced depends on external temperature and use of the recovered oil. In other words, the pour point of the recovered oil should be dependent upon the external temperature, and the thermal oil should be used to meet viscosity conditions suitable for use of the recovered oil. Even though varying with atmosphere temperature, pipe temperature and the properties of the sludge or the thermal oil to be used or treated, a volume ratio of thermal oil/sludge is adjusted to about 3–20, preferably to 5–10.

With introduction of the thermal oil, the thermal oil melts the sludge with or without stirring in the storage tank. In the case of stirring, mixers mounted on the wall of a crude storage tank are enough, and kinds and forms thereof are well known in the art. The above step can be performed without stirring since the sludge is rapidly melted by the thermal oil. That is, large quantities of the preheated thermal oil may provide enough heat to melt the sludge.

Complete removal of the sludge by thermal oil can be confirmed by measuring a point of time showing uniform temperature distribution of the whole mixture comprising thermal oil and sludge. If the temperature of the sludge at the bottom of storage tank accords with the temperature of the upper parts of the bulky mixture of thermal oil and sludge, it is concluded that the sludge is totally melted.

Figure 2:
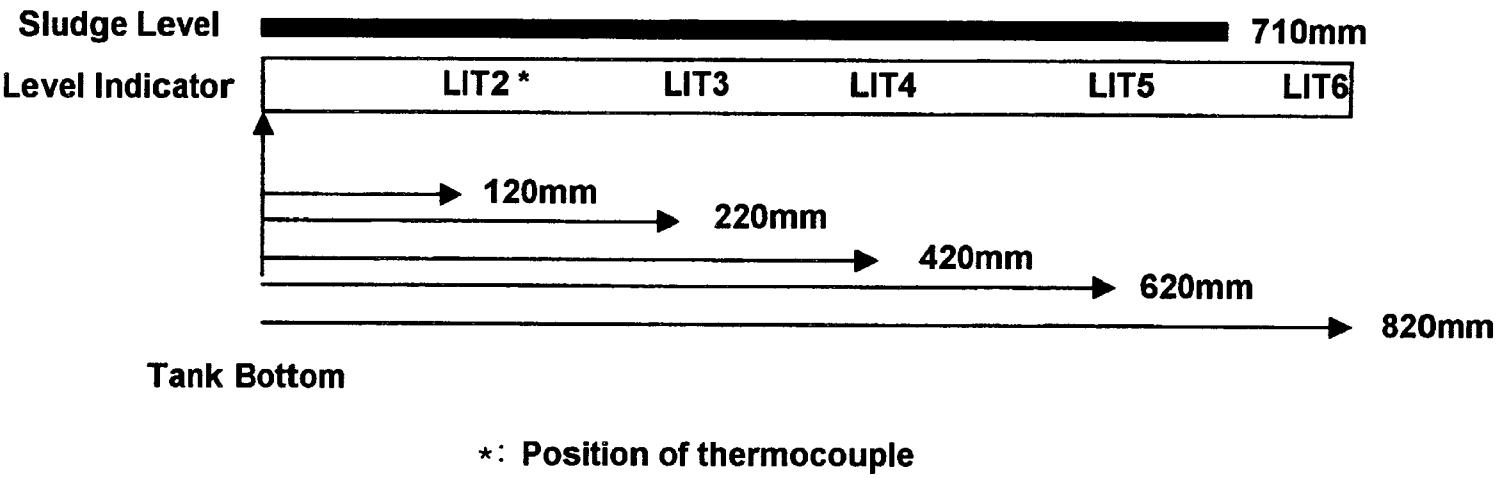
FIG. 2 is a diagram showing a position of thermocouple tip in a sludge level indicator, indicating the amount of sludge in a crude oil storage tank, during the sludge removal process according to the present invention.

A sludge level indicator designed to monitor the melting process of the sludge by measuring current level of the sludge, is mounted in the crude oil storage tank, as shown in FIG. 2.

Said sludge level indicator contains a plural number of thermocouple tips located at regular intervals. The temperature of thermocouple tips located in the tank is mainly affected by heat of fusion of the sludge owing to low thermal conductivity of the sludge. Hence, when the temperature of the sludge at a certain height in the tank is equal to the temperature of the top portion of the sludge level indicator, the position of the sludge at equivalent temperature indicates the current sludge level. This means that the sludge is totally melted when the temperature of the bottom tip in the sludge level indicator is equal to the top tip. Accordingly, a completion point of time of the sludge removal process can be found. Meanwhile, the temperature may be lowered by the consumption of heat of fusion and external dissipation of heat during the sludge removal, so the mixture of the sludge and thermal oil is circulated through heat exchanger-mounted circulation lines and thus may be maintained at constant temperature range.

After completion of the sludge removal process, inorganics (e.g., inorganic components such as mud, rust dregs and so on) contained in the mixture of thermal oil and sludge are allowed to stand at 60° C. or higher, preferably at 60–130° C., thereby separating the oil (hereinafter, recovered oil) from said mixture. The reason why the temperature of 60° C. or higher is required is that the higher the temperature, the lower the viscosity, thus improving removal of inorganics. Compounds such as dispersion agents, may be optionally used, as necessary.

Said procedure may be performed in the crude oil storage tank itself, or in an additional separation tank connected to the tank.

When said separation procedure is carried out in the crude oil storage tank, stirring is stopped and then the temperature of 60° C. or higher is maintained, thus causing inorganics to settle to the bottom of the tank. In the case of not using the additional separation tank, separation efficiency of inorganics is slightly lower and problems may be caused on use of the crude oil storage tank, but investment cost can be reduced.

In the case of using the separation tank for separating recovered oil and inorganics from the mixture of said thermal oil and sludge, basic separation principles are the same as mentioned above.

In this regard, stirring is stopped and then the mixture of said thermal oil and sludge is transferred from the crude oil storage tank to the separation tank through out of service line. As such, when a stripping tank is used as the separation tank, additional cost is not required.

After said transfer procedure is completed, the crude oil storage tank may be opened for regular repair by common washing procedures or may be refilled with crude oil.

The inorganics accumulated in the separation tank need not be removed so long as they do not affect fusible volume of the tank. But, when being removed, the accumulated inorganics are manually removed by scraping after opening the separation tank.

Thusly recovered oil may be used as marine oil or a feed for secondary treatment processes. The recovered oil contains slightly more wax than thermal oil but can be used for said application.

FIG. 1 shows an embodiment of the sludge removal and the oil withdrawal process of the present invention.

As can be seen in said drawing, the sludge removal and the oil withdrawal lines comprise a thermal oil storage tank 1, a crude oil storage tank 2, a separation tank 3, a pump 4 and a heat exchanger 5.

Commonly, the thermal oil yielded from an oil refining step is stored in the thermal oil storage tank 1 at 80–130° C. according to a post-treatment step, and may be stored at temperatures below said temperature range. In the case of the temperature of the thermal oil is a process operation temperature (i.e., 50–130° C.), said thermal oil is transferred to the crude oil storage tank 2 under operation of the pump 4 and the heat exchanger 5.

The heat exchanger 5 is responsible for supplying the heat obtained by steam introduced when the temperature of the thermal oil is 50° C. or lower, to the thermal oil. Simultaneously, the exchanger compensates for a lowering of the temperature of the mixture comprising thermal oil and sludge caused by the consumption of heat of fusion and heat loss during the sludge removal.

When the temperature of the thermal oil introduced to the crude oil storage tank 2 is 50° C. or lower, the thermal oil is circulated to the separation tank 3 until it reaches 50–130° C., the temperature required for the sludge removal process by the mounted pump 4 and heat exchanger 5. During said circulation procedure, the valve 7 is closed, and the thermal oil is circulated to the separation tank 3 through inner loop lines 14 and 15. Hence, when the thermal oil reaches 50–130° C., the thermal oil is transferred to the crude oil storage tank 2 with opening the valve 7 under the operation of the pump 4 and the thermal exchanger 5.

As such, the temperature and the amount of the thermal oil for effective sludge removal are preferably determined according to the heat loss through pipelines.

The crude oil in the tank 2 is discharged as fully as possible through an external line 18. At that time, it is preferred that the amount of remaining crude oil is minimized for safety reasons. Then, the accumulated amount is measured through the sludge level and, as shown in FIG. 2, the sludge level indicator 6 including a plural number of thermocouple tips is mounted to a desired location in the tank 2.

As the thermal oil of high temperature is introduced to the crude oil storage tank 2, the melting begins from the upper parts of the sludge. As mentioned above, because the heat of fusion and externally lost heat lower the temperature of the sludge and thus the sludge may be solidified during the sludge removal, the mixture comprising the thermal oil and the sludge is circulated through external loop lines 17 and 14 while maintaining constant temperature using said pump 4 and heat exchanger 5 by on-off control of the valve.

During the sludge removal, when the temperature of the bottom tip of the sludge level indicator 6 mounted in the tank 2 accords with the top tip, the molten mixture comprising the thermal oil and the sludge is transferred to the separation tank 3 through lines 17 and 15.

In the separation tank maintained at 60° C. or higher, inorganics are settled and thus separated from the oil. A period of time necessary for settling is preferably about 8 hours. Inorganics-removed oil is back-transferred to the tank 1 via the lines 11 and 16 and then stored. Thusly recovered oil may be used as marine oil or a feed for the secondary treatment process.

A better understanding of the present invention may be obtained in light of the following examples which are set forth to illustrate, but are not to be construed to limit the present invention.

EXAMPLE 1

Laboratory tests were conducted to understand the sludge melting mechanism in a tank. In 3 L beaker, sludge was introduced to a height of 10 cm, on which atmospheric residue was filled to an equal volume as the sludge. As such, the sludge might float to the surface, and thus a heavy tube was introduced in the beaker so as to fix the sludge in situ.

The atmospheric residue was heated by use of a heat exchanger made of copper tubes, and water was circulated on the exterior using a thermostat as a heat source. A stirrer was provided at a central position and operated at a low speed of 20 rpm. As such, operation temperature was 65–80° C. A thermocouple having multi-tips was installed in the beaker to observe the change of the sludge level.

As a result of said test, it was confirmed that about 4 hours were required to melt a thickness of sludge of 10 cm, and so this laboratory test could be scaled-up to actual oil refining work sites.

EXAMPLE 2

A test to monitor separation of inorganics in a separation tank was performed.

The sludge and the atmospheric residue (B-C, which refers to an atmospheric residue in high sulfur content of crude oil storage tank) were mixed at a volume ratio of 1:4 in a 3 L glass decanter, and melted with stirring at 80° C. Samples in an oven maintained at 80° C. were extracted according to time, and measured for content of inorganics and ignition loss by ICP (inductively coupled plasma).

Vanadium contained in the sludge did not affect separation by settling because of being present in a state combined with hydrocarbons. Inorganics separable by settling were rust components resulting from corrosion of the storage tank and components contained in salt water. The sludge contained iron at thousands to tens of thousands ppm.

Figure 3:
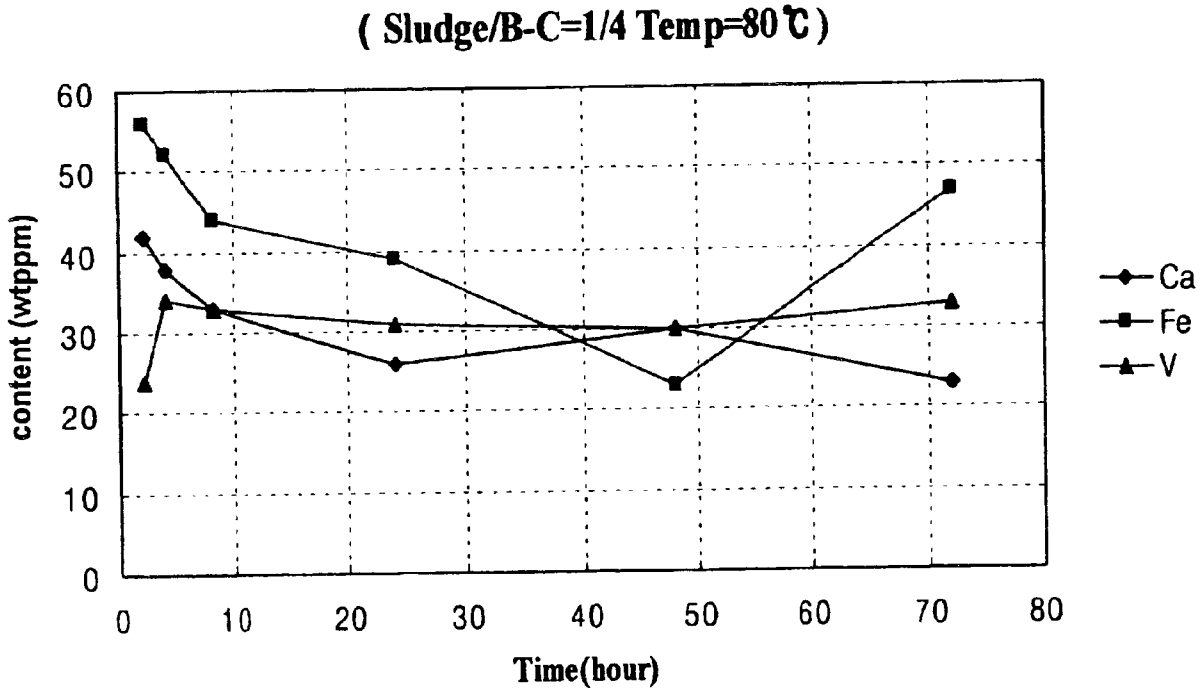
FIG. 3 is a graph showing inorganics content versus time, of the upper sample in a separation tank in accordance with Example 2.
Figure 4:
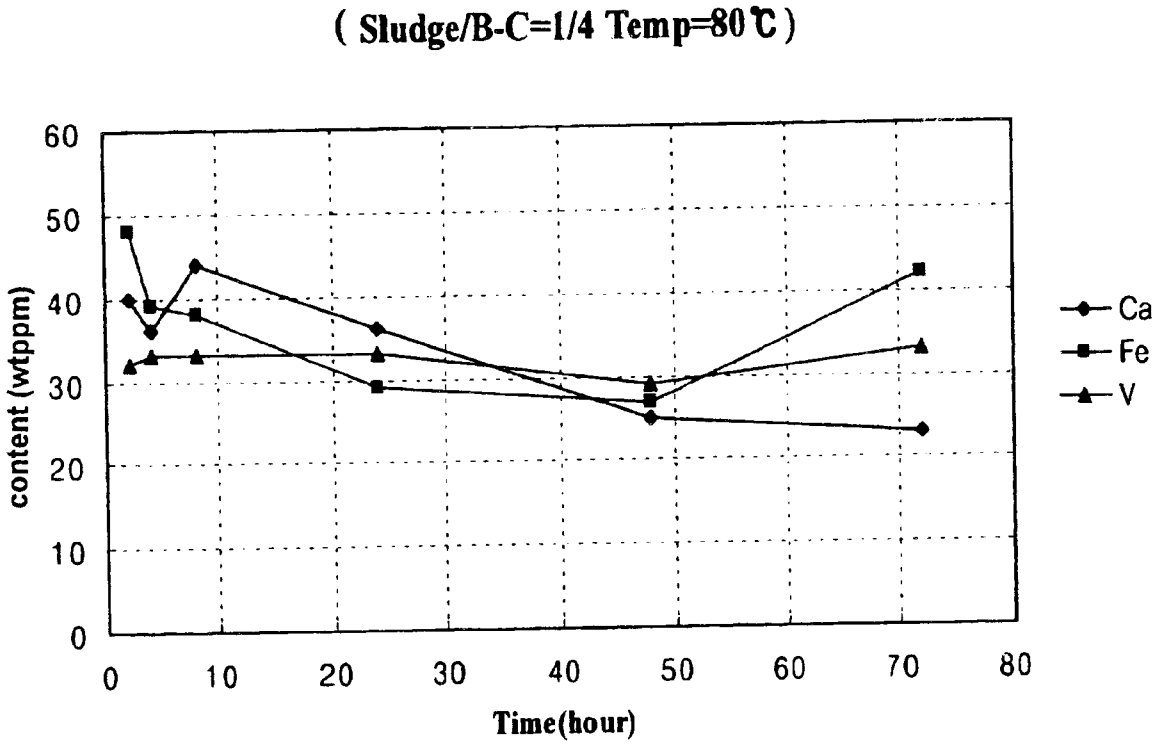
FIG. 4 is a graph showing inorganics content versus time, of the intermediate sample in a separation tank in accordance with Example 2.

The separation according to time in the upper layer and intermediate layer is shown in FIGS. 3 and 4. In the case of the sample in the upper layer and the intermediate layer, thousands to tens of thousands ppm of Fe content were reduced to 100 ppm within one hour, and, after 8 hours, reached about 40 ppm, where it remained constant. It was noted that, at 80° C., the inorganics, such as rust resulting from corrosion, were rapidly separated.

From the observation that ignition loss was 99.8% or more, it can be inferred that inorganics were separated.

EXAMPLE 3

To verify effectiveness of the present invention, the present invention was applied to a practical process. The test was conducted as a One-Through test by use of only the atmospheric residue of 80° C. as a heat source, without the heat exchanger and the pump, to preferentially determine investment needs and technique effectiveness. The used crude oil storage tank was a 750,000 bbl tank for storing crude oil with high sulfur content. Before the test, the sludge was accumulated in the amount of about 2,540 tons (approximately 16,000 bbl, assuming specific gravity of 1) in the tank.

The main object of said test was to verify the effectiveness of the sludge removal process, rather than to use recovered oil, so the sludge level was observed using 84,000 bbl of atmospheric residue of 80° C. as the heat source. As such, the volume ratio of the atmospheric residue to sludge was 5.3:1. Said atmospheric residue was introduced to the crude oil storage tank through conventional pipelines.

The crude oil was discharged before the introduction of the thermal oil, and the amount of the sludge was measured, followed by mounting the sludge level indicator, as shown in FIG. 2. In said drawing, LIT shows the position of thermocouple tips in the sludge level indicator. Each tip shows the temperature of the bulk phase after the sludge was melted. That is, the position indicates the level of the sludge. From the result of the test, it can be seen that said sludge level indicator is suitable to monitor progress of the sludge removal process.

Figure 5:
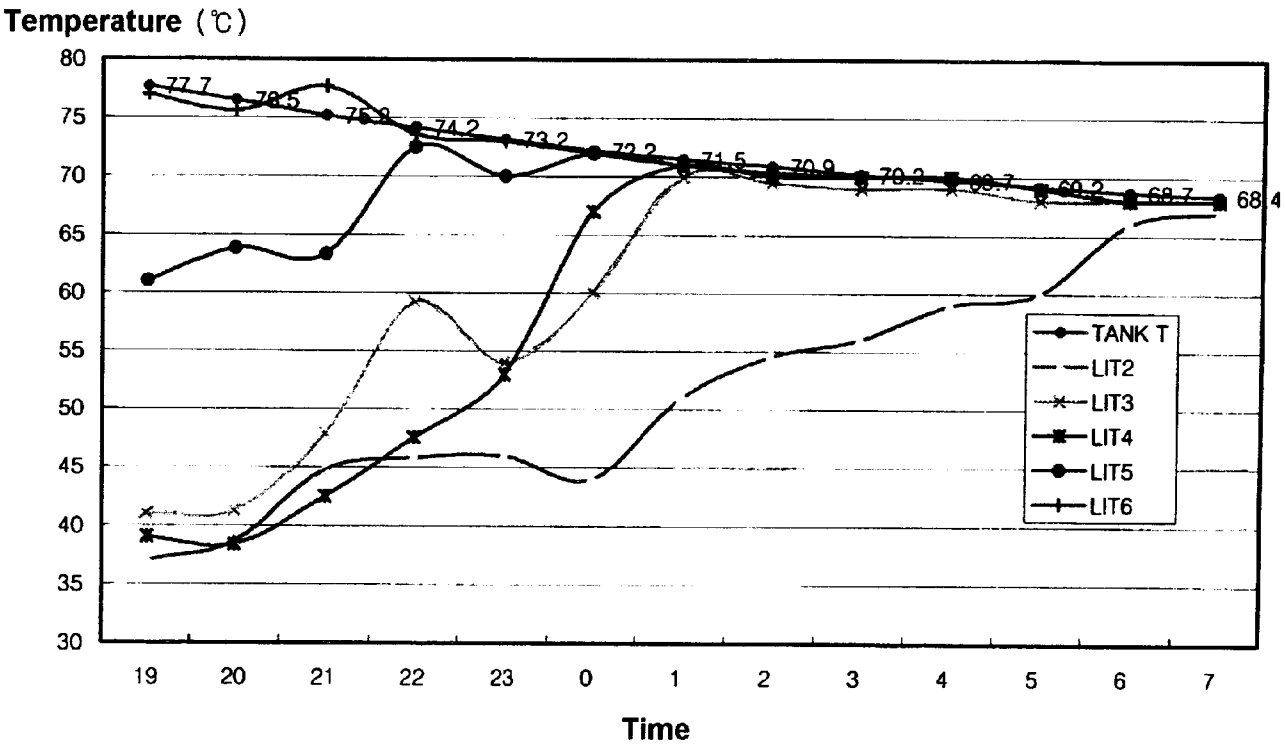
FIG. 5 is a graph showing change of sludge level versus time, during the sludge removal process in a crude oil storage tank in accordance with Example 3.
Figure 6:
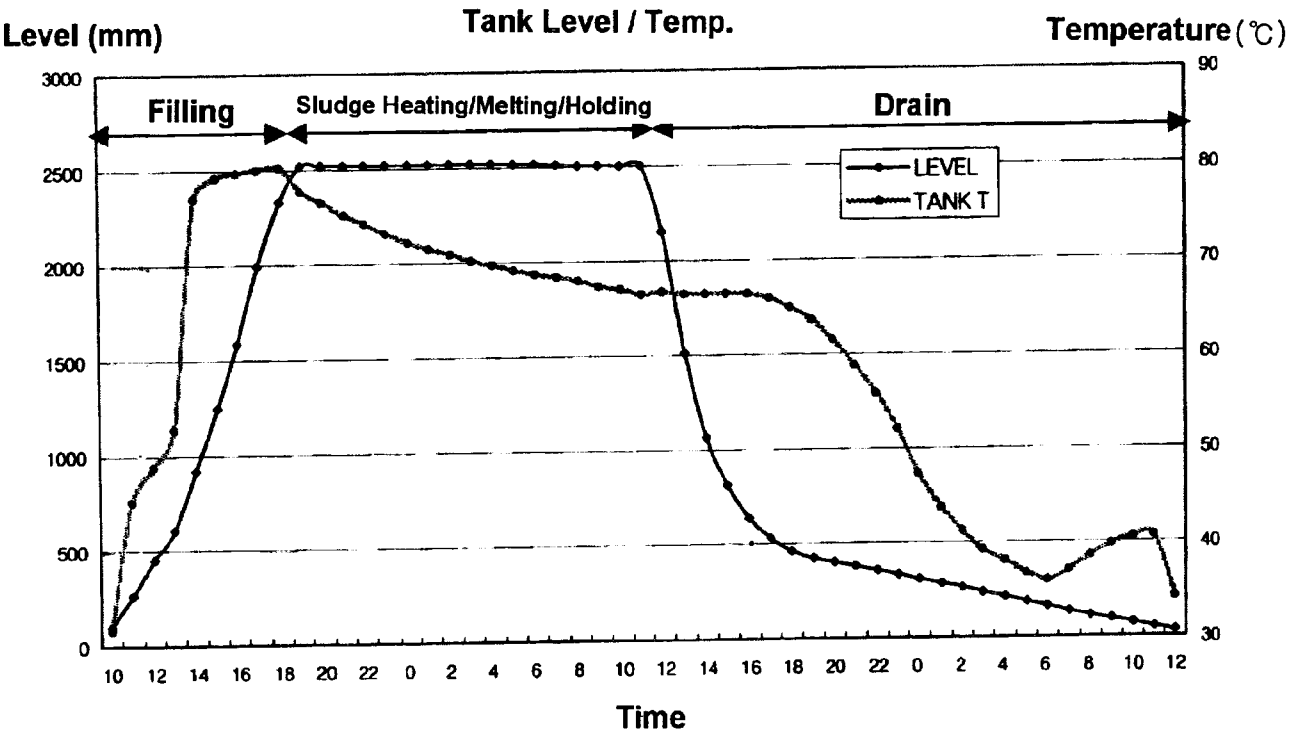
FIG. 6 is a graph showing change of temperature of bulk phase and sludge level versus time of mixture comprising thermal oil and sludge in a crude oil storage tank in accordance with Example 3.

The result of the test is illustrated in FIGS. 5 and 6. In FIG. 5, there is shown the temperature changes of each thermocouple tip. The cause of the temperature of the bulk phase being reduced is construed to be the sludge fusion heat and the heat loss through the tank wall. In the case of practical sludge removal processes, the temperature reduction is balanced by the heat supplied from the heat exchanger, separately mounted, and the temperature of the bulk phase is constantly maintained. During the test, external temperature was approximately 20° C. From the results shown in FIG. 5, it can be seen that, even though the atmospheric residue at 80° C. is used as the heat source in the amount of about 84,000 bbl, the sludge removal efficiency is 80%, so that the process of the present invention can be applied to actual work sites.

FIG. 6 shows the temperature change of bulk phase and sludge level of a mixture comprising atmospheric residue and sludge in the crude oil storage tank. 8 hours are required to provide the atmospheric residue, and 17 hours to melt the sludge.

It can be found that the efficiency of recovery of oil from the sludge is 90% or higher, and the sludge in the crude oil storage tank of 750,000 bbl is removed in only 2–3 days or less in the present invention, compared with conventional removal periods of time of 20–25 days.

The method for removing sludge and recovering oil therefrom of the present invention has advantages that air pollution can be minimized because of using the closed system, the operation is easily performed with minimal initial investment cost, the cleaning time of the tank is drastically reduced, and the sludge can be continuously removed. The thermal oil of high temperature yielded from the oil refining process may be used to remove the sludge, thereby creating economic benefit. In addition, the recovered oil can be used as fuel oil, marine oil, or a feed for secondary treatment process, such as upgrading processes of heavy oil.

The present invention has been described in an illustrative manner, and it is to be understood that the terminology used is intended to be in the nature of description rather than of limitation. Many modifications and variations of the present invention are possible in light of the above teachings. Therefore, it is to be understood that within the scope of the appended claims, the invention may be practiced otherwise than as specifically described.

What is claimed is:

1. A method for removing bottom sludge in a crude oil storage tank and recovering oil therefrom, the bottom sludge having been accumulated during the storage of untreated and unrefined crude oil, comprising the steps of:

(a) introducing thermal oil yielded from an oil refining process into the crude oil storage tank, at a volume ratio of thermal oil to bottom sludge of 3:1 to 20:1, said thermal oil being selected from the group consisting of atmospheric residue, vacuum residue and vacuum gas oil;

(b) melting the sludge by use of the introduced thermal oil with or without stirring until a mixture of the thermal oil and the sludge has a homogeneous temperature distribution;

(c) allowing the molten mixture of the thermal oil and the sludge to stand in the crude oil storage tank or an additional separation tank connected to the crude oil storage tank in order to settle inorganics contained therein; and (d) recovering oil components separated from the inorganics by the settlement, wherein the bottom sludge removal in the crude oil storage tank is carried out under a closed system.

2. The method as defined in claim 1, wherein said (b) step is carried out at 50 to 130° C.

3. The method as defined in claim 1, wherein said (c) step is carried out at 60 to 130° C.

4. The method as defined in claim 1, wherein the temperature of the thermal oil introduced into the crude oil storage tank in said (a) step is 80 to 130° C.

5. The method as defined in claim 1, wherein the boiling point of said thermal oil is 250 to 580° C.

6. The method as defined in claim 1, wherein the specific gravity of said thermal oil is 0.9 to 1.0.

7. the method as defined in claim 1, wherein a sludge level indicator including a plural number of thermocouple tips located at regular intervals is mounted in said crude oil storage tank, and a point of time at which the bottom tip of said sludge level indicator becomes equal in temperature to the top tip is determined as a completion point of time of said (b) step.

8. The method as defined in claim 1, further comprising a step of providing said recovered oil as fuel oil, marine oil or a feed for secondary treatment processes.

9. The method as defined in claim 1, wherein said separation tank is a stripping tank.

10. A method for removing bottom sludge in a crude oil storage tank and recovering oil therefrom, the bottom sludge having been accumulated during the storage of untreated and unrefined crude oil, comprising the steps of:

(a) introducing thermal oil from a thermal oil storage tank into a the crude oil storage tank at a volume ratio of thermal oil to bottom sludge of 3:1 to 20:1 under operation of a pump and a heat exchanger, said thermal oil being selected from the group consisting of atmospheric residue, vacuum residue and vacuum gas oil, wherein if the thermal oil stored in the thermal oil storage tank is 50° C. or higher, the thermal oil is directly introduced into the crude oil storage tank under operation of the pump and the heat exchanger, while if the thermal oil is less than 50° C., the thermal oil is circulated to a separation tank connected to the crude oil storage tank under the pump and the heat exchanger until reaching 50 to 130° C. and then introduced into said crude oil storage tank, and wherein a sludge level indicator including a plural number of thermocouple tips located at regular intervals is mounted in the crude oil storage tank;

(b) melting the sludge at 50 to 130° by use of the introduced thermal oil with or without stirring until the temperature of the bottom tip in the sludge level indicator accords with that of the top tip, the molten mixture of the thermal oil and the sludge being circulated for maintaining said temperature range under operation of the pump and the heat exchanger;

(c) transferring the molten mixture of the thermal oil and the sludge into the separation tank connected to said crude oil storage tank;

(d) allowing the molten mixture of the thermal oil and the sludge to stand at 60 to 130° C. in the separation tank in order to settle inorganics contained therein; and (e) recovering oil components separated from the inorganics by the settlement, wherein the bottom sludge removal in the crude oil storage tank is carried out under a closed system.

* * * * *